US007279839B2

(12) United States Patent
Menzel et al.

(10) Patent No.: US 7,279,839 B2
(45) Date of Patent: Oct. 9, 2007

(54) SHORT ARC HIGH-PRESSURE DISCHARGE LAMP

(75) Inventors: Lars Menzel, Berlin (DE); Dietmar Ehrlichmann, Berlin (DE); Thomas Mehr, Dollnstein (DE); Stephen Berndanner, Ellingen (DE); Wolfgang Spielmann, Ehrwald (AT); Gerhard Leichtfried, Reutte/Tirol (AT)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 374 days.

(21) Appl. No.: 10/506,528

(22) PCT Filed: Mar. 5, 2003

(86) PCT No.: PCT/DE03/00707

§ 371 (c)(1),
(2), (4) Date: Sep. 3, 2004

(87) PCT Pub. No.: WO03/075310

PCT Pub. Date: Sep. 12, 2003

(65) Prior Publication Data

US 2005/0104521 A1 May 19, 2005

(30) Foreign Application Priority Data

Mar. 5, 2002 (DE) ..... 102 09 426

(51) Int. Cl.
*H01J 17/04* (2006.01)

(52) U.S. Cl. ..... 313/633; 313/572

(58) Field of Classification Search ..... 313/571, 313/572, 633
See application file for complete search history.

(56) References Cited

U.S. PATENT DOCUMENTS

| | | | | |
|---|---|---|---|---|
| 5,081,396 | A * | 1/1992 | Schneider et al. | 313/630 |
| 5,530,317 | A | 6/1996 | Willemsen et al. | |
| 5,789,850 | A | 8/1998 | Kawashima et al. | |
| 5,791,767 | A * | 8/1998 | Inoue et al. | 362/268 |
| 6,046,544 | A * | 4/2000 | Daemen et al. | 313/633 |
| 6,084,351 | A * | 7/2000 | Kai et al. | 313/634 |
| 6,107,741 | A | 8/2000 | Yamaguchi et al. | |
| 6,190,579 | B1 | 2/2001 | Billings | |
| 6,486,602 | B1 * | 11/2002 | Setzer | 313/633 |
| 2001/0035719 | A1 | 11/2001 | Erhlichmann et al. | |
| 2002/0024280 | A1 | 2/2002 | Miyamoto et al. | |

FOREIGN PATENT DOCUMENTS

| | | |
|---|---|---|
| EP | 0 647 964 | 4/1995 |
| EP | 0 866 492 | 9/1998 |

* cited by examiner

*Primary Examiner*—Vip Patel
(74) *Attorney, Agent, or Firm*—William E. Meyer

(57) ABSTRACT

A short arc high-pressure discharge lamp (1) for dc operation, includes a discharge vessel (2) that has two necks (4) diametrically opposite each other, in which an anode (26) and a cathode (7) made of tungsten are melted in a gastight manner, and which has a filling made of at least one noble gas and possibly mercury. According to the invention, at least the material of the cathode tip (11) contains lanthanum oxide $La_2O_3$ and at least another oxide from the group consisting of hafnium oxide $HfO_2$ and zirconium oxide $ZrO_2$ in addition to the abovementioned tungsten.

15 Claims, 4 Drawing Sheets

SHORT ARC HIGH-PRESSURE DISCHARGE LAMP

TECHNICAL FIELD

The invention relates to a short arc high-pressure discharge lamp for direct current operation, having a discharge vessel which includes two diametrically opposite necks, into which an anode and a cathode, in each case made from tungsten, are fused in a gastight manner and which contains a fill comprising at least one noble gas and optionally mercury. Lamps of this type are used as mercury arc lamps in particular for microlithography in the semiconductor industry, to expose wafers, and as xenon arc lamps for cinema and video projection.

PRIOR ART

The mercury short arc high-pressure discharge lamps which are used for the exposure process must supply a high light intensity in the ultraviolet wavelength region—in some cases restricted to a few nanometers of wavelength—with the light generation being restricted to a small spatial area.

Intensive light generation within an extremely small space is likewise a demand imposed on xenon arc lamps for cinema and video projection.

The resulting demand for a high luminance can be achieved by a direct current gas discharge with a short electrode spacing. This produces a plasma with a high light emission in front of the cathode. The strong introduction of electrical energy into the plasma generates electrode temperatures which, in particular in the case of the cathode, cause damage to the material.

For this reason, cathodes of this type have hitherto preferably contained a doping of thorium oxide $ThO_2$, which is reduced to thorium Th during lamp operation, reaches the cathode surface in this metallic form and at the cathode surfaces leads to a drop in the work function of the cathode.

The drop in the work function is associated with a reduction in the operating temperature of the cathode, which leads to a longer service life of the cathode, since less cathode material evaporates at lower temperatures.

The previously preferred use of $ThO_2$ as dopant is based on the fact that the evaporation of the dopant is relatively slight and therefore does not cause extensive disruptive precipitation in the lamp bulb (blackening, deposits). The preferential suitability of $ThO_2$ correlates to a high melting point of the oxide (3323 K) and the metal (2028 K).

However, electrode burn-back cannot be avoided even in the case of thoriated cathodes, and consequently, in the present case of a direct current gas discharge lamp, the cathode burn-back imposes limits on the service life. This is disadvantageous in particular in the case of lamps with short electrode spacings—as are present here—since in this case even slight electrode burn-back leads to extensive changes to the lighting properties of the lamp. However, the main drawback of using $ThO_2$ is its radioactivity, which requires safety precautions to be taken when producing the precursor material and the lamp. Depending on the activity of the product, it is also necessary to comply with regulations relating to storage, operation and disposal of the lamps.

It is particularly urgent to solve the environmental problem for lamps with high operating currents of more than 20 A, as are used in microlithography or projection technology, since these lamps have a particularly high activity on account of the electrode size.

Numerous thorium substitutes have therefore been investigated. Examples of these substitutes are to be found in "Metallurgical Transactions A", vol. 21A, December 1990, pp. 221-3236. The commercial use of substitutes in lamps for microlithography or cinema projection has not hitherto succeeded, since all substitutes led to pronounced bulb deposits on account of the fact that they evaporate more readily than $ThO_2$.

In microlithography, the productivity of exposure equipment is crucially dependent on the light quantity provided by the lamp. Bulb deposits and electrode burn-back reduce the useful light available and lead to a loss of productivity from the very expensive systems, on account of increasing exposure times.

SUMMARY OF THE INVENTION

It is an object of the present invention to provide a short arc high-pressure discharge lamp in accordance with the preamble of claim 1 which makes do without radioactive dopants in the electrode material, ensures low electrode burn-back, is not inferior, or at most only slightly inferior, to the proven prior art with regard to electrode burn-back and, if possible, further reduces the formation of deposits in the lamp bulb during the lamp service life.

This object is achieved in the case of a short arc high-pressure discharge lamp having the features of the preamble of claim 1 by virtue of the fact that at least the material of the cathode tip, in addition to the tungsten, contains lanthanum oxide $La_2O_3$ and at least one further oxide selected from the group consisting of $HfO_2$ and $ZrO_2$.

Tests carried out on different combinations of dopants had revealed that these mixed oxides based on $La_2O_3$ have favorable results with regard to the formation of deposits and electrode burn-back. The doping of the cathode tip with $La_2O_3$ or of the entire cathode should preferably amount to between 1.0 and 3.5% by weight of the cathode material, or preferably between 1.5 and 3.0% by weight of the cathode material. It was attempted to achieve further improvements by adding further oxides or carbides. In this context, it was found that the addition of small quantities of $ZrO_2$ and/or $HfO_2$ makes it possible to achieve a further improvement to the properties in terms of the emitted evaporation. The molar quantity of $ZrO_2$ and $HfO_2$ should in this context advantageously amount to at least 2% of the molar quantity of the $La_2O_3$, but at the same time should not exceed the molar quantity of the $La_2O_3$, since the favorable influence on the light flux is always associated with an increased burn-back of the cathode. An excess of $La_2O_3$ is ensured if the proportion by weight of $HfO_2$ amounts to no more than 0.65 times, and/or the proportion by weight of $ZrO_2$ amounts to no more than 0.38 times, the $La_2O_3$.

The addition of the second oxide has a significant influence on the light flux and electrode burn-back while the lamp is operating. A mercury arc lamp with a power of 1.75 kW, an $La_2O_3$ content in the cathode tip of 2.0% by weight, and a further oxide, revealed the following properties in tests after an operating period of 1500 h:

| | Light flux based on 0 h = 100% | Cathode burn-back |
|---|---|---|
| Content of second oxide $HfO_2$ in % by weight | | |
| 0.0% | 85% | 0.22 mm |
| 0.1% | 89% | 0.21 mm |
| 0.5% | 92% | 0.31 mm |
| 1.0% | 92% | 0.43 mm |
| 2.0% | 84% | 0.55 mm |
| Content of second oxide $ZrO_2$ in % by weight | | |
| 0.1% | 87% | 0.25 mm |
| 0.5% | 94% | 0.29 mm |
| 1.0% | 86% | 0.52 mm |
| 2.0% | 74% | 0.83 mm |

The following values were observed when using thoriated cathodes (2% by weight of $ThO_2$):

| Light flux based on 0 h = 100% | Cathode burn-back |
|---|---|
| 94% | 0.27 mm |

The improvement to the light flux in pure xenon arc lamps produced by the addition of a second oxide in the form of $ZrO_2$ and/or $HfO_2$ when using $La_2O_3$-doped cathodes was also detectable. The addition of oxide in this case too reduces the strong discharge of doping substance, which leads to rapid formation of deposits on the bulb.

Cathodes made from thorium-free material have a larger arc attachment on account of their properties, in particular when using mixed oxides. The optimum burn-back of cathodes of this type can be ensured if the plateau size of the cathode is adapted accordingly. If the plateau size were not adapted, either the arc would attach to a plateau edge (if the plateau is too large) or would engage well over the edge of the plateau (plateau too small). In both cases, without an optimized plateau size, electrode damage, with an associated increase in burn-back, would be discernible. Since the plateau may be of either planar or curved form, the optimum plateau size can in technical terms best be defined by giving the current density in the cathode at a distance of 0.5 mm behind the cathode tip. Tests carried out on cathodes which were doped with $La_2O_3$ and also with $ZrO_2$ and/or $HfO_2$ revealed that the cathode burn-back with this cathode material can be optimally minimized if the form of the cathodes is such that the current density J in the cathode, i.e. the quotient of lamp current J in A and effective surface area S at a distance of 0.5 mm from the cathode tip toward the rear end of the cathode, is no less than 5 and no greater than 150 $A/mm^2$ in the case of a mercury/noble gas fill and no less than 25 and no greater than 200 $A/mm^2$ in the case of a pure noble gas fill.

BRIEF DESCRIPTION OF THE DRAWINGS

In the text which follows, the invention is to be explained in more detail on the basis of an exemplary embodiment. In the drawing.

PREFERRED EMBODIMENTS OF THE INVENTION

Figure 1:
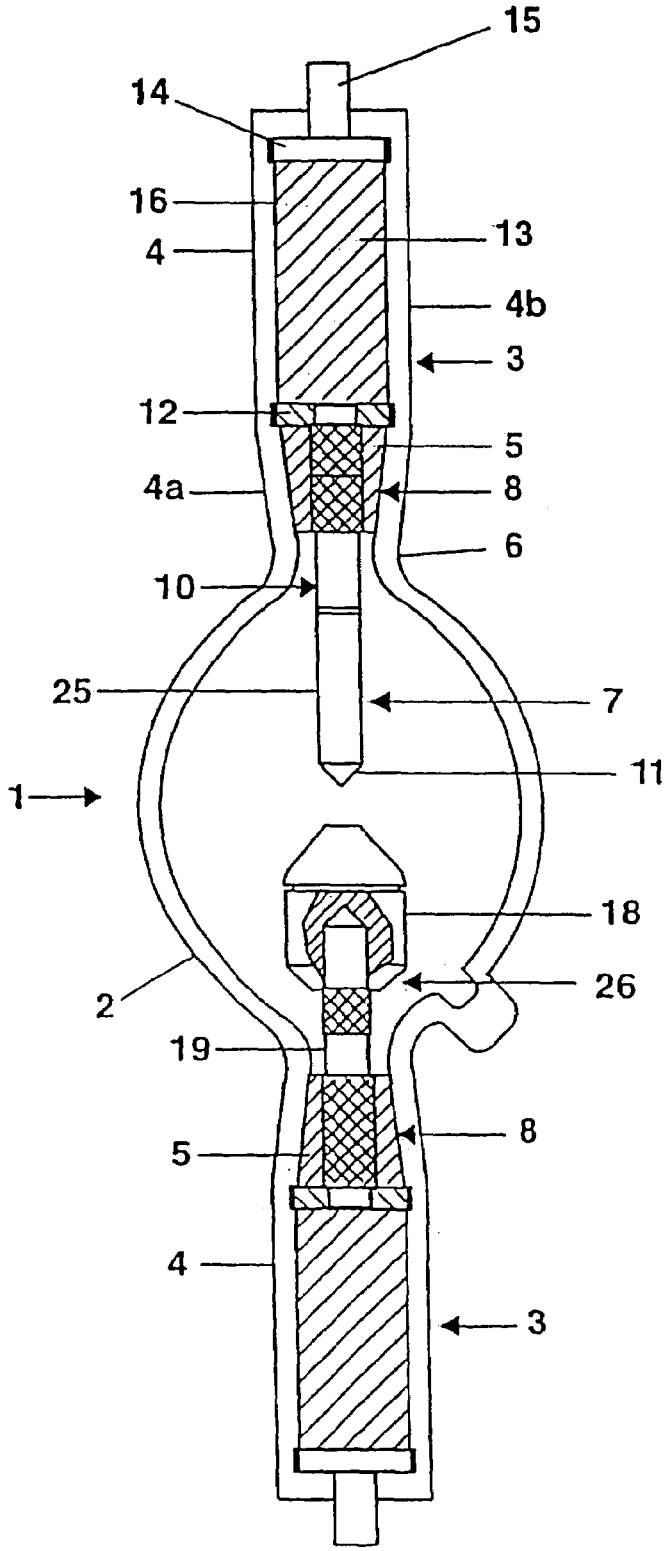
FIG. 1 shows a mercury short arc high-pressure discharge lamp according to the invention in section.

FIG. 1 shows, in section, a mercury short arc high-pressure discharge lamp 1 according to the invention with a power of 1.75 kW. It has a bulb 2 made from quartz glass which is shaped elliptically. This is adjoined on two opposite sides by two ends 3 which are designed as bulb necks 4 and each include holding parts 8. The necks have a front conical part 4*a*, which includes a small supporting roll 5 made from quartz glass as the main component of the holding part, and a rear cylindrical part 4*b*, which forms the fused seal. The front part 4*a* has a contraction 6 with a length of 5 mm. This is in each case adjoined by a small supporting roll 5 with a central hole which is conical in shape. Its internal diameter is 7 mm, its external diameter at the front end is 11 mm, the external diameter at the rear end is 15 mm. The wall thickness of the bulb 2 is approximately 4 mm in this region. The axial length of the small supporting roll is 17 mm.

A shank 10 of a cathode 7 with an external diameter of 6 mm, which extends as far as into the discharge volume, where it bears an integral head part 25, is guided axially in the hole in the first small supporting roll. The shank 10 is extended at the rear to beyond the small supporting roll 5 and ends at a disk 12, which is adjoined by the fused seal in the form of a cylindrical quartz block 13. This in turn is followed by a second disk 14, which in the center holds an external current feed in the form of a molybdenum rod 15. Four molybdenum foils 16 run along the outer surface of the quartz block 13 in a manner which is known per se and are fused to the wall of the bulb neck in a gastight manner.

The anode 26, comprising separate head part 18 and shank 19, is held in the hole in the second small supporting roll 5 in a similar way.

Figure 2:
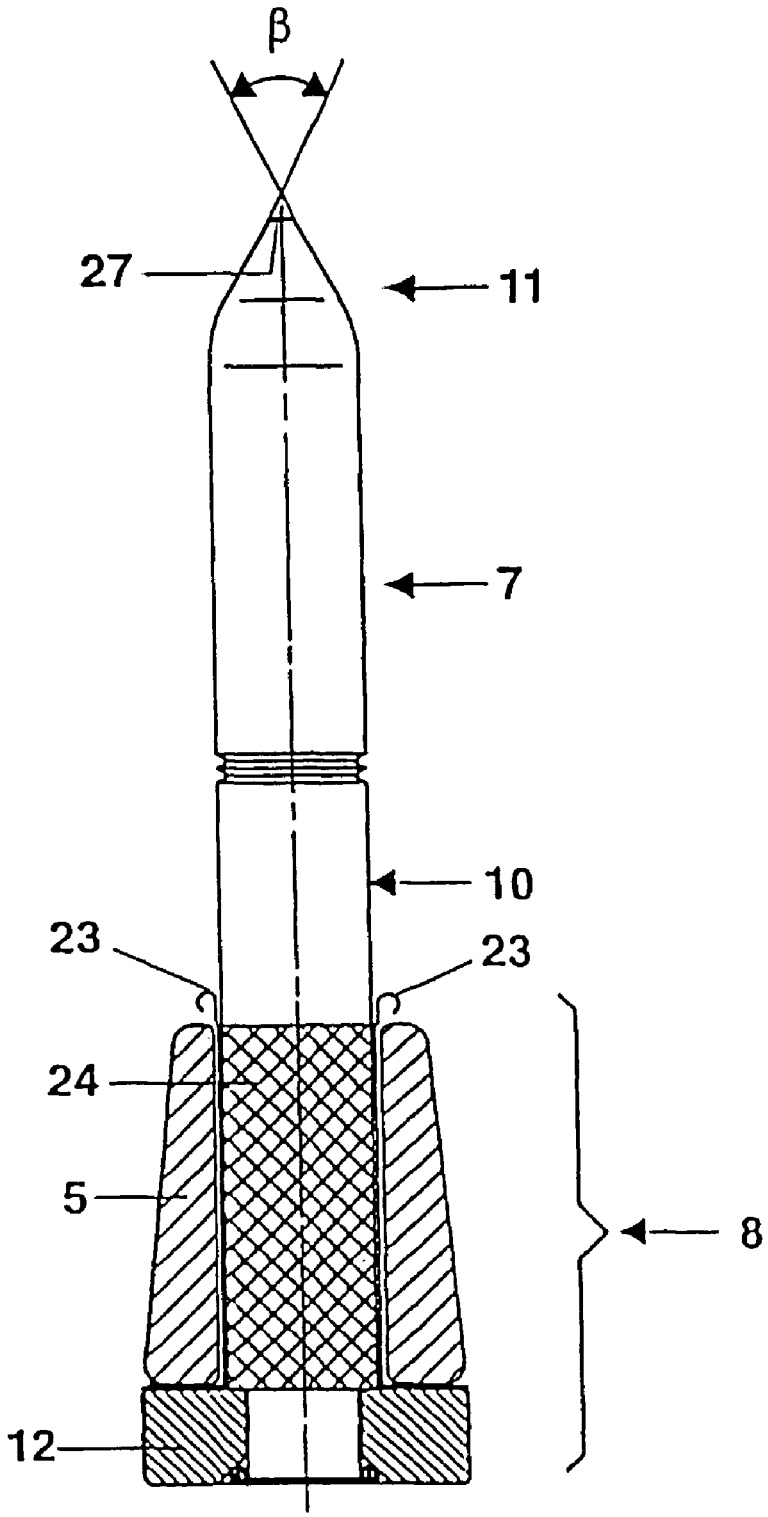
FIG. 2 shows a detailed excerpt from the cathode of the mercury short arc high-pressure discharge lamp shown in FIG. 1.

FIG. 2 shows a detail view of the cathode 7 and the holding part 8. The cathode 7 is composed of a cylindrical shank 10 with a length of 36 mm and a head 25 with a length of 20 mm, the head 25 and the shank having an external diameter of 6 mm. That end of the head 25 which faces the anode is designed as a tip 11 with a tip angle β of 60° and has a plateau-like end 27 with a diameter of 0.5 mm. The holding part comprises small supporting roll 5 and a plurality of foils in its hole.

A foil 24 is wound around the shank a number of times (two to four layers) in order to mechanically separate the small supporting roll and shank. A pair of narrow foils 23, which lie opposite one another on the wound foil 24, are used for fixing the small supporting roll. For this purpose, they project beyond the small supporting roll on the discharge side and are bent over outward. The material of the tip 11 of the cathode 7 includes, in addition to tungsten, a doping of 2.0% by weight of $La_2O_3$ and 0.5% by weight of $ZrO_2$.

The mercury short arc high-pressure discharge lamp according to the invention has a discharge vessel with a volume of 134 $cm^3$, which is filled with 603 mg of mercury and xenon with a cold-fill pressure of 800 mbar.

The operating current of the lamp with an electrode spacing of 4.5 mm is 60 A. The current density J in the cathode at a distance of 0.5 mm from the plateau tip is 66 $A/mm^2$ when the lamp is operating.

Figure 3:
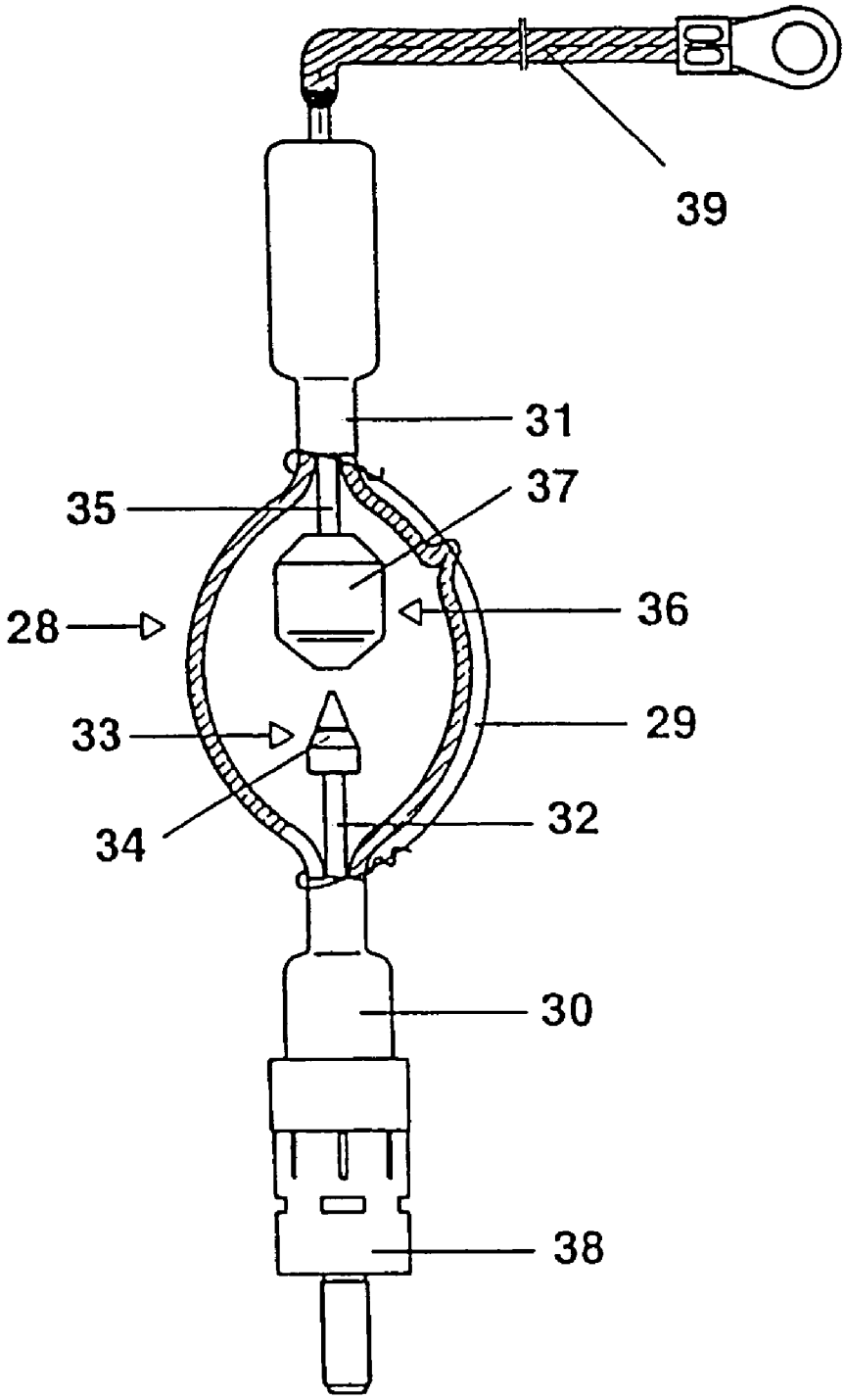
FIG. 3 shows a xenon short arc high-pressure discharge lamp according to the invention, partially in section.

FIG. 3 shows a short arc high-pressure discharge lamp 28 according to the invention with a pure Xe fill. The lamp 28, with a power consumption of 3 kW, comprises a rotationally symmetrical lamp bulb 29 made from quartz glass, with a lamp neck 30, 31, likewise made from quartz glass, fitted to each of its two ends. An electrode rod 32 of a cathode 33 is fused in a gastight manner into one neck 30; the inner end of this electrode rod bears a cathode head 34. An electrode rod 35 of an anode 36 is likewise fused in a gastight manner into the other lamp neck 31 and has an anode head 37 secured to its inner end. Cap systems 38, 39 for holding and for electrical contact are fitted to the outer ends of the lamp necks 30, 31.

Figure 4:
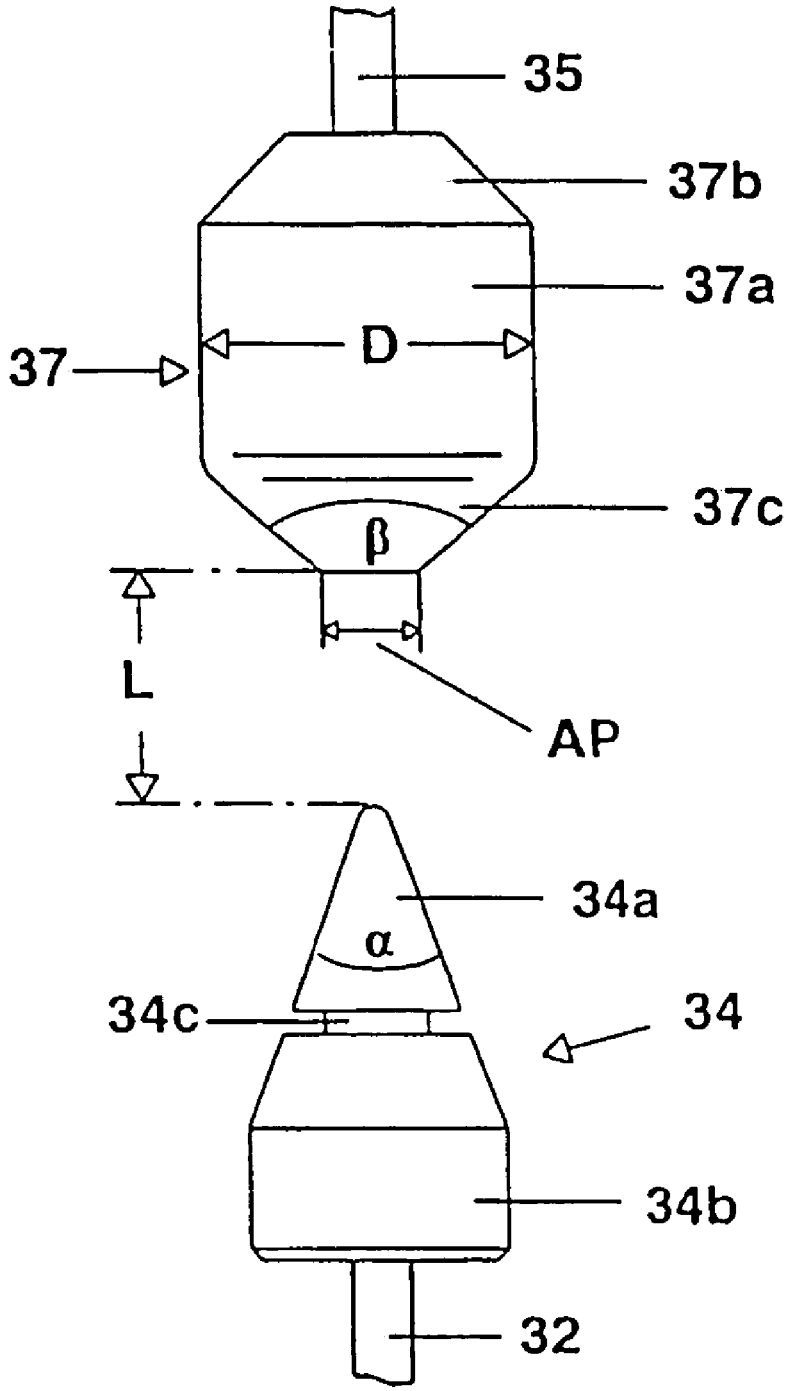
FIG. 4 shows the electrode arrangement of the xenon short arc high-pressure discharge lamp shown in FIG. 3 on an enlarged scale.

As can be seen from FIG. 4, the cathode head 34 is composed of a conical end section 34*a* facing the anode head 37 and an end section 34*b* which faces the electrode rod 32 and includes a cylindrical subsection and a frustoconical subsection, with a likewise cylindrical section 34*c* of smaller diameter, referred to as the thermal barrier groove, being located between these two sections 34*a*, 34*b*. The tip of the conical end section 34*a*, facing the anode head 37, of the cathode head 34, with a cone angle $\alpha$ of 40°, is designed as a hemisphere with a radius R of 0.6 mm. The lamp current is in this case 100 A, and the resulting current density at the reference surface 0.5 mm behind the cathode tip is 88 $A/mm^2$.

The anode head 37 comprises a cylindrical middle section 37*a* with a diameter D of 22 mm and two frustoconical end sections 37*b*, 37*c* which face the cathode head 34 and the electrode rod 35, respectively. The frustoconical end section 37*c* that faces the cathode head 34 has a plateau AP with a diameter of 6 mm. All the sections of the two electrodes 33, 36 consist of tungsten. In addition, the conical end section 34*a* of the cathode head 34 includes a doping of 2.0% by weight of $La_2O_3$ and 0.5% by weight of $HfO_2$.

The two electrodes 33, 36 are arranged opposite one another on the axis of the lamp bulb 29, in such a way that when the lamp is in the hot state an electrode spacing or arc length of 3.5 mm results.

The invention claimed is:

1. A short arc high-pressure discharge lamp (1, 28) for direct current operation, having a discharge vessel (2, 29) which includes two diametrically opposite necks (4; 30, 31), into which an anode (26, 36) and a cathode (7, 33), in each case made from tungsten, are fused in a gastight manner and which contains a fill comprising at least one noble gas and optionally mercury, characterized in that at least the material of the cathode tip (11, 34*a*), consists of tungsten, lanthanum oxide $La_2O_3$ and at least one further oxide selected from the group consisting of hafnium oxide $HfO_2$ and zirconium oxide $ZrO_2$.

2. The short arc high-pressure discharge lamp as claimed in claim 1, characterized in that the cathode material of the entire cathode (7, 34) consists of tungsten and $La_2O_3$ and at least one further oxide selected from the group consisting of $HfO_2$ and $ZrO_2$.

3. The short arc high-pressure discharge lamp as claimed in claim 1, characterized in that the $La_2O_3$ content of the cathode material is from 1.0 to 3.5% by weight.

4. The short arc high-pressure discharge lamp as claimed in claim 1, characterized in that the $La_2O_3$ content of the cathode material is from 1.5 to 3.0% by weight.

5. The short arc high-pressure discharge lamp as claimed in claim 1, characterized in that the additional molar quantity of zirconium oxide $ZrO_2$ and hafnium oxide $HfO_2$ does not exceed that of the $La_2O_3$ in the cathode material.

6. The short arc high-pressure discharge lamp as claimed in claim 1, characterized in that the additional molar quantity of zirconium oxide $ZrO_2$ and hafnium oxide $HfO_2$ amounts to at least 2% of the molar quantity of the $La_2O_3$.

7. The short arc high-pressure discharge lamp as claimed in claim 1, characterized in the electrode spacing between anode (26) and cathode (7) in the discharge vessel (2) is less than or equal to 8 mm.

8. The short arc high-pressure discharge lamp as claimed in claim 1, characterized in that the electrode spacing between anode (36) and cathode (33) in the discharge vessel (29) is less than or equal to 15 mm.

9. The short arc high-pressure discharge lamp as claimed in claim 1, characterized in that the lamp current when the lamp (1, 28) is operating is greater than 20 A.

10. The short arc high-pressure discharge lamp as claimed in claim 1, characterized in that the form of the cathode (7) is such that when the lamp is operating the current density J, i.e. the quotient of lamp current in A and effective cathode surface area in $mm^2$ for an area which results from a section through the cathode perpendicular to the lamp axis at a distance of 0.5 mm from the tip of the cathode, satisfies the following equation: $5 \leqq J \leqq 150$ in the case of a mercury/noble gas fill.

11. The short arc high-pressure discharge lamp as claimed in claim 2, characterized in that the $La_2O_3$ content of the cathode material is from 1.0 to 3.5% by weight.

12. The short arc high-pressure discharge lamp as claimed in claim 2, characterized in that the $La_2O_3$ content of the cathode material is from 1.5 to 3.0% by weight.

13. The short arc high-pressure discharge lamp as claimed in claim 2, characterized in that the additional molar quantity of zirconium oxide $ZrO_2$ and hafnium oxide $HfO_2$ does not exceed that of the $La_2O_3$ in the cathode material.

14. The short arc high-pressure discharge lamp as claimed in claim 2, characterized in that the additional molar quantity of zirconium oxide $ZrO_2$ and hafnium oxide $HfO_2$ amounts to at least 2% of the molar quantity of the $La_2O_3$.

15. The short arc high-pressure discharge lamp as claimed in claim 1, characterized in that the form of the cathode (7) is such that when the lamp is operating the current density J, i.e. the quotient of lamp current in A and effective cathode surface area in $mm^2$ for an area which results from a section through the cathode perpendicular to the lamp axis at a distance of 0.5 mm from the tip of the cathode, satisfies the following equation: $25 \leqq J \leqq 200$ in the case of a pure noble gas fill.

* * * * *